US005708450A

United States Patent [19]

Kawasaki et al.

[11] Patent Number: 5,708,450

[45] Date of Patent: Jan. 13, 1998

[54] FLUORESCENT DISPLAY DEVICE AND METHOD FOR DRIVING SAME

[75] Inventors: Hiroaki Kawasaki; Hiroshi Yamaguchi; Yoshimichi Matsuda; Itaru Hatori, all of Mobara, Japan

[73] Assignee: Futaba Denshi Kogyo K.K., Mobara, Japan

[21] Appl. No.: 87,899

[22] Filed: Jul. 9, 1993

[30] Foreign Application Priority Data

Jul. 14, 1992 [JP] Japan ..... 4-186962
Jan. 26, 1993 [JP] Japan ..... 5-010883
May 17, 1993 [JP] Japan ..... 5-114876

[51] Int. Cl.[6] ..... G09G 3/06

[52] U.S. Cl. ..... 345/47

[58] Field of Search ..... 345/33, 37, 41, 345/42, 43, 47, 74, 75; 445/25

[56] References Cited

U.S. PATENT DOCUMENTS 3,986,760 10/1976 Kishino ..... 445/25
4,218,636 8/1980 Miyazawa ..... 345/47
4,401,982 8/1983 Miyazaki ..... 345/47

*Primary Examiner*—Curtis Kuntz
*Assistant Examiner*—Vivian Chang
*Attorney, Agent, or Firm*—Oblon, Spivak, McClelland, Maier & Neustadt, P.C.

[57] ABSTRACT

A fluorescent display device capable of setting anode patterns as desired without being restricted by a configuration of grids. A plurality of grids formed into the same rectangular shape are juxtaposed to each other at micro intervals. First single anode patterns each are arranged so as to face each of grid groups each consisting of four to six single grids adjacent to each other. Second single anode patterns each are arranged so as to face each one single grids. The second single anode patterns are driven for every grid and then the grid groups facing the first single anode patterns are selected. Concurrently, the anode patterns facing the grid groups are fed with a display signal. Thus, the grid is commonly applied to any fluorescent display device and accommodates to any anode pattern.

5 Claims, 15 Drawing Sheets

| | 10G | 9G | 8G | 7G | 6G | 5G | 4G | 3G | 2G | 1G |
|---|---|---|---|---|---|---|---|---|---|---|
| P1 | | a | | a | | a | | a | | 3 |
| P2 | | b | | b | | b | | b | | 4 |
| P3 | | c | | c | | c | | c | | 5 |
| P4 | | d | | d | | d | | d | | 8 |
| P5 | | e | | e | | e | | e | | 9 |
| P6 | | f | | f | | f | | f | | 10 |
| P7 | | g | | g | | g | | g | | 13 |
| P8 | | | | | | | | | | 14 |
| P9 | a | | a | | a | | a | | 1 | |
| P10 | b | | b | | b | | b | | 2 | |
| P11 | c | | c | | c | | c | | 6 | |
| P12 | d | | d | | d | | d | | 7 | |
| P13 | e | | e | | e | | e | | 11 | |
| P14 | f | | f | | f | | f | | 12 | |
| P15 | g | | g | | g | | g | | 16 | |
| P16 | MULTI | | — | — | JUST | | — | — | 17 | |
| P17 | ▷ | | — | — | LINK | | — | — | — | 15 |
| P18 | — | PGM | | — | — | EDIT | | — | — | 18 |
| P19 | — | [][] | | — | — | — | FADE | — | — | 19 |
| P20 | — | — | SHUFFLE | | | — | — | — | — | 20 |
| P21 | — | — | REPEAT | | | — | — | — | — | — |
| P22 | — | — | — | STEP | — | — | — | — | — | — |

FIG.5

| | 10G | 9G | 8G | 7G | 6G | 5G | 4G | 3G | 2G | 1G |
|---|---|---|---|---|---|---|---|---|---|---|
| P1 | | a | | a | | a | | a | | 3 |
| P2 | | b | | b | | b | | b | | 4 |
| P3 | | c | | c | | c | | c | | 5 |
| P4 | | d | | d | | d | | d | | 8 |
| P5 | | e | | e | | e | | e | | 9 |
| P6 | | f | | f | | f | | f | | 10 |
| P7 | | g | | g | | g | | g | | 13 |
| P8 | | | | | | | | | | 14 |
| P9 | a | | a | | a | | a | | 1 | |
| P10 | b | | b | | b | | b | | 2 | |
| P11 | c | | c | | c | | c | | 6 | |
| P12 | d | | d | | d | | d | | 7 | |
| P13 | e | | e | | e | | e | | 11 | |
| P14 | f | | f | | f | | f | | 12 | |
| P15 | g | | g | | g | | g | | 16 | |
| P16 | MULTI | | — | — | JUST | | — | — | 17 | |
| P17 | ▷ | | — | — | LINK | | — | — | — | 15 |
| P18 | — | PGM | | — | — | EDIT | | — | — | 18 |
| P19 | — | ▯▯ | | — | — | — | FADE | — | — | 19 |
| P20 | — | — | SHUFFLE | | | — | — | — | — | 20 |
| P21 | — | — | REPEAT | | | — | — | — | — | — |
| P22 | — | — | — | STEP | — | — | — | — | — | — |

FIG.7

| | 10G | 9G | 8G | 7G | 6G | 5G | 4G | 3G | 2G | 1G |
|---|---|---|---|---|---|---|---|---|---|---|
| P1 | a | a | a | a | a | a | a | a | 1 | 3 |
| P2 | b | b | b | b | b | b | b | b | 2 | 4 |
| P3 | c | c | c | c | c | c | c | c | 6 | 5 |
| P4 | d | d | d | d | d | d | d | d | 7 | 8 |
| P5 | e | e | e | e | e | e | e | e | 11 | 9 |
| P6 | f | f | f | f | f | f | f | f | 12 | 10 |
| P7 | g | g | g | g | g | g | g | g | 16 | 13 |
| P8 | — | — | — | — | 1 | — | — | — | 17 | 14 |
| P9 | MULTI | | SHUFFLE | | | A | — | — | — | 15 |
| P10 | △ | | REPEAT | | | — | B | — | — | 16 |
| P11 | — | PGM | | — | JUST | | — | TIME | — | 19 |
| P12 | — | □ | | — | LINK | | — | FADE | — | 20 |
| P13 | — | — | — | STEP | — | DISC | | | | |
| P14 | — | — | — | — | — | EDIT | | | | |

FIG.13

| | 11G | 10G | 9G | 8G | 7G | 6G | 5G | 4G | 3G | 2G | 1G |
|---|---|---|---|---|---|---|---|---|---|---|---|
| P1 | a | a | a | a | a | a | a | a | 1 | 3 | |
| P2 | b | b | b | b | b | b | b | b | 2 | 4 | |
| P3 | c | c | c | c | c | c | c | c | 6 | 5 | |
| P4 | d | d | d | d | d | d | d | d | 7 | 8 | |
| P5 | e | e | e | e | e | e | e | e | 11 | 9 | |
| P6 | f | f | f | f | f | f | f | f | 12 | 10 | |
| P7 | g | g | g | g | g | g | g | g | 16 | 13 | |
| P8 | — | — | STEP | | ooo | | | — | 17 | 14 | |
| P9 | MALTI | | SHUFFLE | | | EDIT | | — | — | 15 | |
| P10 | ▷ | | REPEAT1 | | | DISC | | — | — | 18 | |
| P11 | — | PGM | | — | JUST | | TIME | | — | 19 | |
| P12 | — | ▯▯ | | — | LINK | | FADE | | — | 20 | |

FIG.19

| | 10G | 9G | 8G | 7G | 6G | 5G | 4G | 3G | 2G | 1G |
|---|---|---|---|---|---|---|---|---|---|---|
| P1 | a | a | a | a | a | a | a | a | 1 | 3 |
| P2 | b | b | b | b | b | b | b | b | 2 | 4 |
| P3 | c | c | c | c | c | c | c | c | 6 | 5 |
| P4 | d | d | d | d | d | d | d | d | 7 | 8 |
| P5 | e | e | e | e | e | e | e | e | 11 | 9 |
| P6 | f | f | f | f | f | f | f | f | 12 | 10 |
| P7 | g | g | g | g | g | g | g | g | 16 | 13 |
| P8 | — | — | — | — | — | — | — | — | 17 | 14 |
| P9 | MULTI | PGM | — | SHUFFLE | ▫▫▫ | JUST | EDIT | TIME | — | 15 |
| P10 | ▷ | ▯▯ | — | REPEAT | — | LINK | A | FADE | — | 18 |
| P11 | — | — | — | 1 | — | ▫ | B | — | — | 19 |
| P12 | — | — | — | STEP | — | — | DISC | — | — | 20 |

FLUORESCENT DISPLAY DEVICE AND METHOD FOR DRIVING SAME

BACKGROUND OF THE INVENTION

This invention relates to a fluorescent display device adapted to impinge electrons emitted from cathodes on anode patterns while controlling the electrons by means of mesh grids to excite phosphors of the anode patterns, resulting in carrying out a luminous display and a method for driving the same, and more particularly to a fluorescent display device including a plurality of mesh grids formed into the same configuration so as to be accommodated to anode patterns even when the anode patterns are formed in a complicated manner and a method for driving the same.

In general, a conventional fluorescent display device, as shown in FIG. 18, includes a plurality of anode patterns and a plurality of grids 1G to 10G each divided in conformity to a configuration of each of the anode pattern and arrangement thereof. Of the anode patterns, anode patterns arranged in a shape of the FIG. 8 for indicating numerals or the like each are divided into seven segments, which are connected to different anode wirings, respectively.

The segments thus formed in the conventional fluorescent display device shown in FIG. 18 are connected to anode wirings P1 to P12 in such a manner as shown in FIG. 19 in relation to the grids 1G to 10G.

Thus, the conventional fluorescent display device, as described above, is so constructed that the grids are configured and arranged in conformity to the segments, resulting in the anode patterns each facing each of the grids. Therefore, the conventional fluorescent display device may carry out displaying, for example, by scanning the grids 1G to 10G and feeding each of the anodes P1 to P12 with a display signal in synchronism with the scanning.

Unfortunately, the conventional fluorescent display device constructed as described above has some disadvantages.

More particularly, in the conventional fluorescent display device, the grids 1G to 10G are configured in conformity to the anode patterns. The anode patterns are extensively varied in configuration, arrangement and the like depending on a demand of a user. Such a change in anode patterns requires to change a configuration of the grids correspondingly. This causes a mold for forming the grids to be changed, leading to an increase in manufacturing cost of the fluorescent display device. Also, the mold is subject to restriction on a design, so that manufacturing of the anode patterns is limited.

Also, in the conventional fluorescent display device, the grids each include a support member for supporting the grid above the segment. The support element must be arranged so as to conform to the anode pattern formed into a complicated configuration and extensively changed as described above. However, a modification of the support element is highly difficult and causes the support element to be complicated in structure.

A configuration of the grid is determined depending on the anode pattern. Thus, the grid fails to be commonly used for a plurality of kinds of fluorescent display devices which are different in anode pattern from each other. Further, when grids which are different in configuration and dimensions from each other are used in combination in a single fluorescent display device, a capacity of each of a driver and a power supply must be determined on the basis of a grid through which an increased grid current flows, resulting in deteriorating driving efficiency of the fluorescent display device.

SUMMARY OF THE INVENTION

The present invention has been made in view of the foregoing disadvantages of the prior art.

Accordingly, it is an object of the present invention to provide a fluorescent display device which is capable of effectively preventing an increase in manufacturing cost of the device.

It is another object of the present invention to provide a fluorescent display device which is capable of preventing grids from being restricted by a configuration of anode patterns.

It is another object of the present invention to provide a fluorescent display device which includes grids commonly applied to a variety of anode patterns.

It is a further object of the present invention to provide a fluorescent display device which is capable of freely setting anode patterns as desired irrespective of a configuration of the grids.

In accordance with one aspect of the present invention, a fluorescent display device is provided. The fluorescent display device includes a plurality of grids juxtaposed to each other and at least one single anode pattern, wherein two or more of the grids corresponding to the single anode pattern are concurrently driven as a single grid.

Also, in accordance with this aspect of the present invention, a fluorescent display device is provided. The fluorescent display device includes a plurality of anode patterns and a plurality of grids. At least a part of the anode patterns is arranged so as to extend over two or more of the grids and controlled by the two or more grids.

In the fluorescent display device of the present invention constructed as described above, two or more grids corresponding to the anode pattern are concurrently driven. Therefore, the present invention permits an area for the single grid to be set in correspondence to the anode pattern as desired.

In accordance with another aspect of the present invention, there is provided a method for driving a fluorescent display device including a plurality of grids and anode patterns wherein at least a part of the anode patterns is arranged so as to extend over n (n: integer) grids adjacent to each other. The method comprises the steps of concurrently applying a scanning signal to the grids and scanning the grids while shifting the grids one by one and applying a display signal to anode electrodes in synchronism with the scanning so that the anode patterns may have the same luminous time length.

In accordance with this aspect of the present invention, there is also provided a method for driving a fluorescent display device in which a part of a plurality of anode patterns is controlled by single grids and another part of the anode patterns is controlled by plural grids. The method comprises the steps of scanning the single grids one by one in order and applying a display signal to anode electrodes controlled by the single grids and scanning the plural grids two or more for every one time in order and applying a display signal to anode electrodes controlled by the plural grids.

In the method of the present invention constructed as described above, light emission of the anode pattern arranged so as to extend over two or more grids is carried out by turning on the grids concurrently and feeding anode electrodes of the anode patterns with a display signal in synchronism with the turning-on.

In accordance with a further aspect of the present invention, a fluorescent display device is provided. The fluorescent display device includes a plurality of anode patterns provided on an inner surface of an anode substrate constituting a part of an envelope and a plurality of mesh grids formed into the same configuration and arranged in the envelope so as to be spaced at predetermined intervals from the anode patterns, wherein at least one of the anode patterns is arranged so as to face the mesh grids adjacent thereto.

In a preferred embodiment of the present invention, the mesh grids each include a peripheral section and mesh section, wherein the peripheral section is formed of a wire material having the same diameter as that for the mesh section into a linear shape.

In a preferred embodiment of the present invention, the mesh grids are fixedly mounted directly on the inner surface of the anode substrate.

In the fluorescent display device of the present invention constructed as described above, a control electrode section is constructed of the mesh grids each formed into the same configuration or a predetermined configuration. Driving of each of the mesh grids permits the mesh grid to be scanned and the anode electrodes to be fed with a display signal, resulting in the fluorescent display device carrying out a desired display. The peripheral section of each of the mesh grids may be formed of a wire material of the same diameter as that for the mesh section. Such construction effectively prevents the peripheral section of the mesh grid from putting luminance of the anode pattern out of sight.

In accordance with still another aspect of the present invention, a fluorescent display device is provided. The fluorescent display device includes a plurality of grids formed independent from each other and single anode patterns. Two or more of the grids corresponding to each of the single anode patterns are previously electrically connected to each other in the fluorescent display device.

In the fluorescent display device thus constructed, two or more grids electrically connected together function as a single grid for the anode pattern.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 5 is a diagram showing connection between anodes and segments and correspondence between grids and the segments in the fluorescent display device shown in FIG. 4;

FIG. 7 is a diagram showing connection between anodes and segments and correspondence between grids and the segments in a further embodiment of a fluorescent display device according to the present invention;

FIG. 13 is a diagram showing correspondence between anode patterns and mesh grids in the embodiment of FIG. 9;

FIG. 19 is a diagram showing connection between anodes and segments and correspondence between grids and the segments in the conventional fluorescent display device of FIG. 18.

DETAILED DESCRIPTION OF THE PREFERRED EMBODIMENTS

Figure 1:
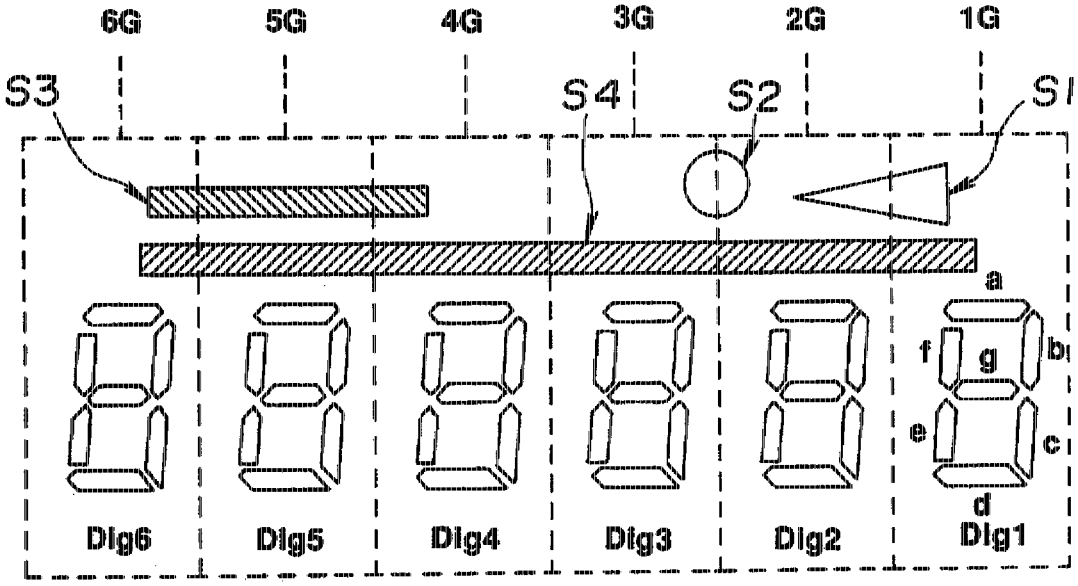
FIG. 1 is a schematic plan view showing arrangement of grids and anode patterns in an embodiment of a fluorescent display device according to the present invention.

Now, the present invention will be described hereinafter with reference to FIGS. 1 to 17, in which like reference numerals designate like or corresponding parts throughout.

Figure 3:
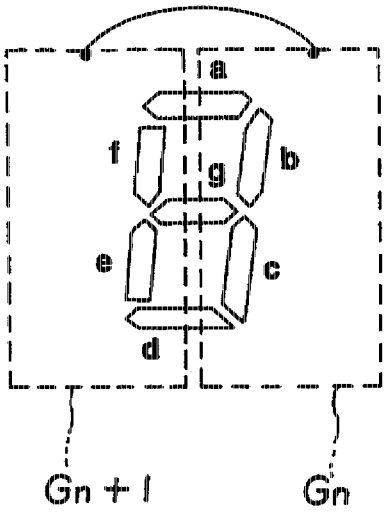
FIG. 3 is a fragmentary schematic plan view showing a modification of the fluorescent display device of FIG. 1.
Figure 2:
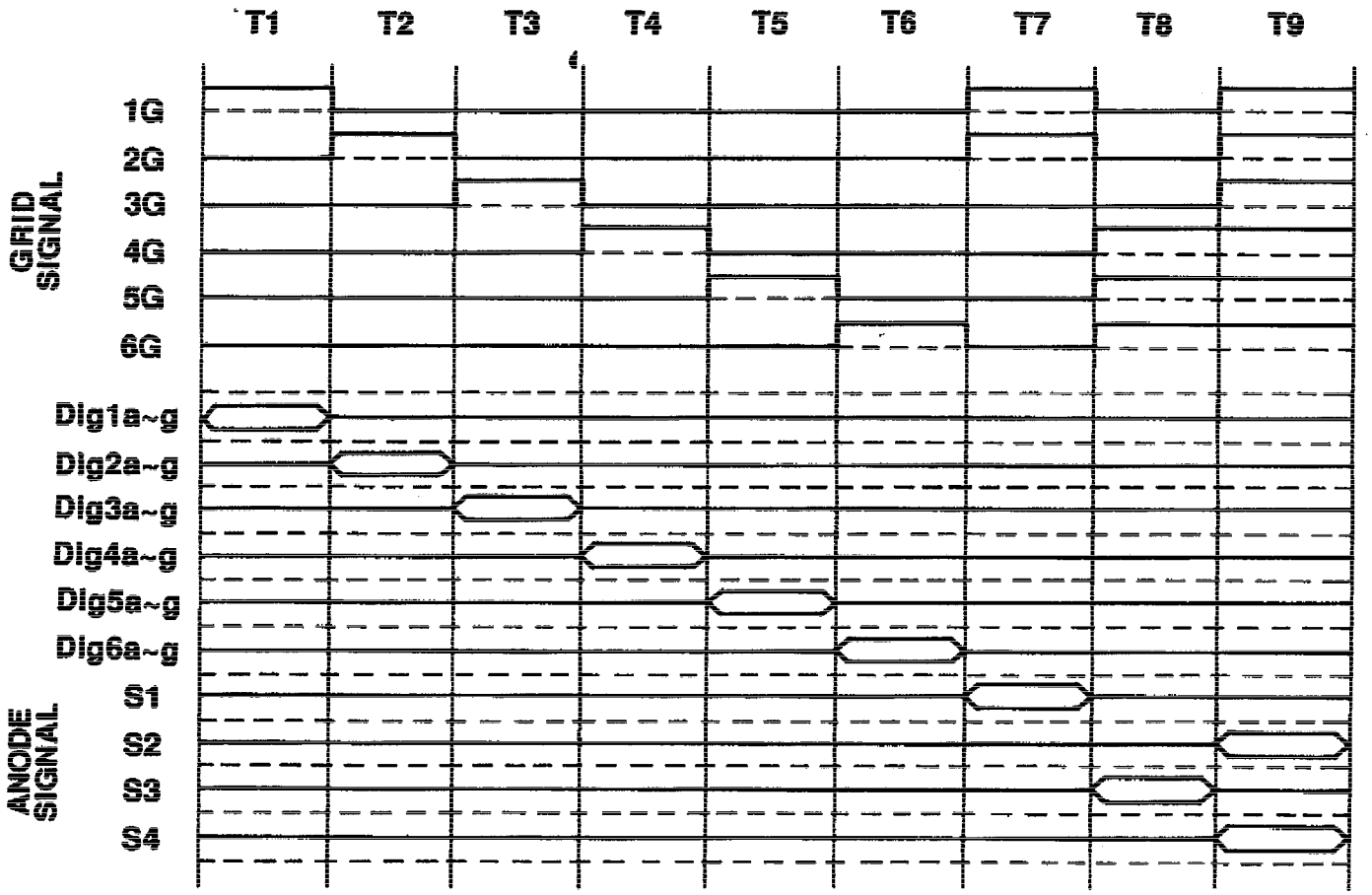
FIG. 2 is a timing chart showing a manner of driving of the fluorescent display device of FIG. 1.

Referring first to FIGS. 1 to 3, an embodiment of a fluorescent display device according to the present invention is illustrated. A fluorescent display device of the illustrated embodiment includes four single anode patterns S1, S2, S3 and S4 and six anode patterns Dig1 to Dig6 for digital displaying each of which is a single anode pattern. The anode patterns are formed on a substrate (not shown).

The fluorescent display device of the illustrated embodiment also includes grids 1G to 6G arranged side by side above the anode patterns so as to be spaced from each other at micro intervals or distances. The grids 1G to 6G are formed into the same rectangular configuration. Two or more of the grids corresponding to each of the single anode patterns are concurrently driven so as to function as a single grid. In the illustrated embodiment, the grids 1G and 2G corresponding to the single anode pattern S1 function as a single grid with respect to the anode pattern S1. Likewise, the grids 2G and 3G corresponding to the single anode pattern S2; the grids 4G, 5G and 6G corresponding to the single anode pattern S3; and the grids 1G, 2G, 3G, 4G, 5G and 6G corresponding to the single anode pattern S4 function as a single grid with respect to the anode patterns S2, S3 and S4, respectively. The grids functioning as a single grid with respect to each of the anode patterns corresponding, thereto are concurrently driven at a predetermined timing.

The grids 1G to 6G, as shown in FIG. 2, are scanned at predetermined timings and anode electrodes each are fed with a display signal required, resulting in displaying being carried out by the anode patterns. At timings T1 to T6 in one display cycle T1 to T9, the grids 1G to 6G are scanned in order and the anode patterns Dig1 to Dig6 for digital displaying are fed with a display signal in synchronism with the scanning, respectively.

At a timing T7, the grids 1G and 2G are concurrently selected and the anode pattern S1 is fed with a display signal. At a timing T8, the grids 4G, 5G and 6G are simultaneously selected and the anode pattern S3 is fed with a display signal. At a timing T9, all the grids 1G to 6G are simultaneously selected and the anode pattern S4 is fed with a display signal.

In the embodiment shown in FIG. 1, the anode patterns Dig1 to Dig6 for digital displaying are arranged so as to correspond to the single grids 1G to 6G, respectively. Alternatively, when the anode pattern of the FIG. 8 for digital displaying, as shown in FIG. 3, is formed into dimensions large sufficiently to cause one grid to fail to cover the anode pattern, the anode pattern may be arranged so as to extend over two or more grids $G_n$, $G_{n+1}$, - - - . In this instance, driving of the anode pattern of the FIG. 8 may be carried out by selecting two or more such grids corresponding thereto.

Figure 4:
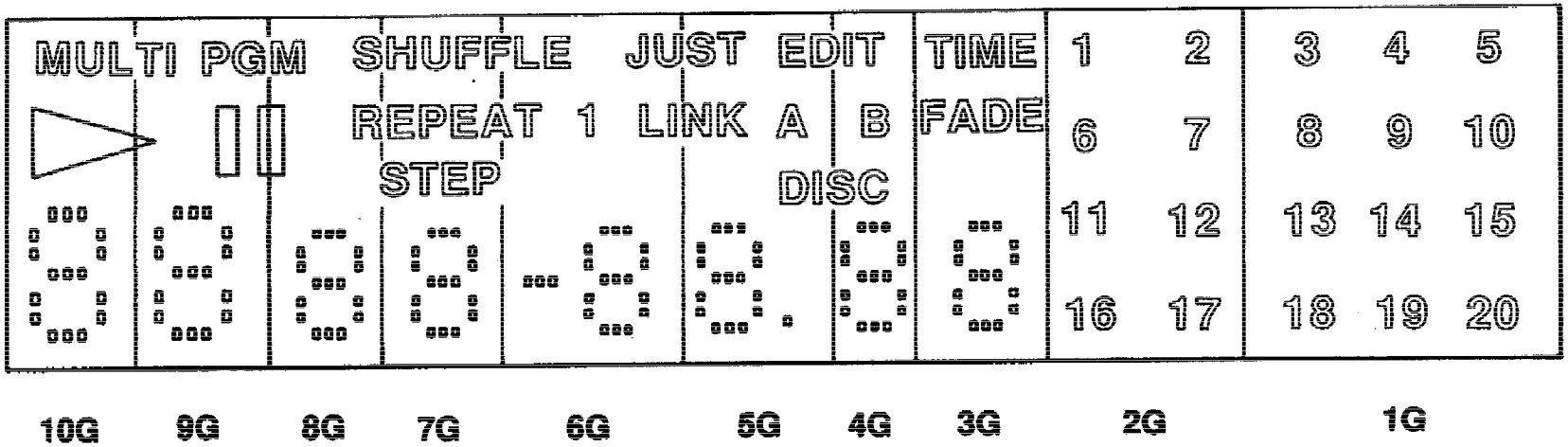
FIG. 4 is a schematic plan view showing a configuration of segments and grids and arrangement thereof in another embodiment of a fluorescent display device according to the present invention.
Figure 6:
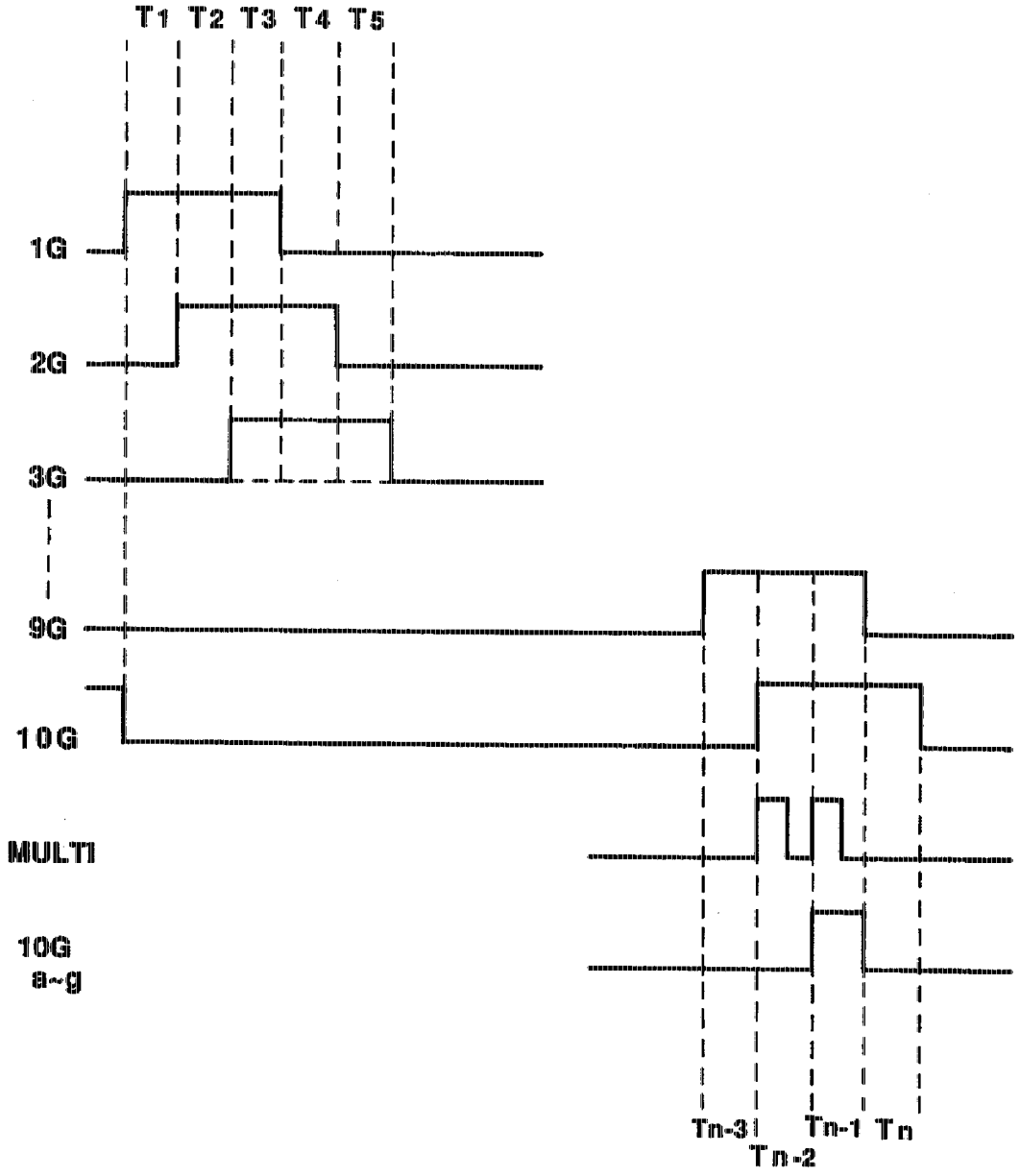
FIG. 6 is a timing chart showing a manner of driving of the fluorescent display device of FIG. 4.

Referring now to FIGS. 4 to 6, another embodiment of a fluorescent display device according to the present invention is illustrated. A fluorescent display device of the illustrated embodiment includes a plurality of anode patterns and a plurality of grids 1G to 10G which are configured and arranged in a manner shown in FIG. 4. The term "anode pattern" used herein indicates an anode or an anode electrode comprising an anode conductor and a phosphor deposited on the anode conductor and serving as a display section and is formed into at least one pattern depending on an object of displaying. For example, as shown in FIG. 4, the anode patterns may include anode patterns for displaying numerals of 1 to 20, anode patterns for displaying a variety of functions, and anode patterns formed into a shape of the FIG. 8 for displaying numerals and the like.

Figure 8:
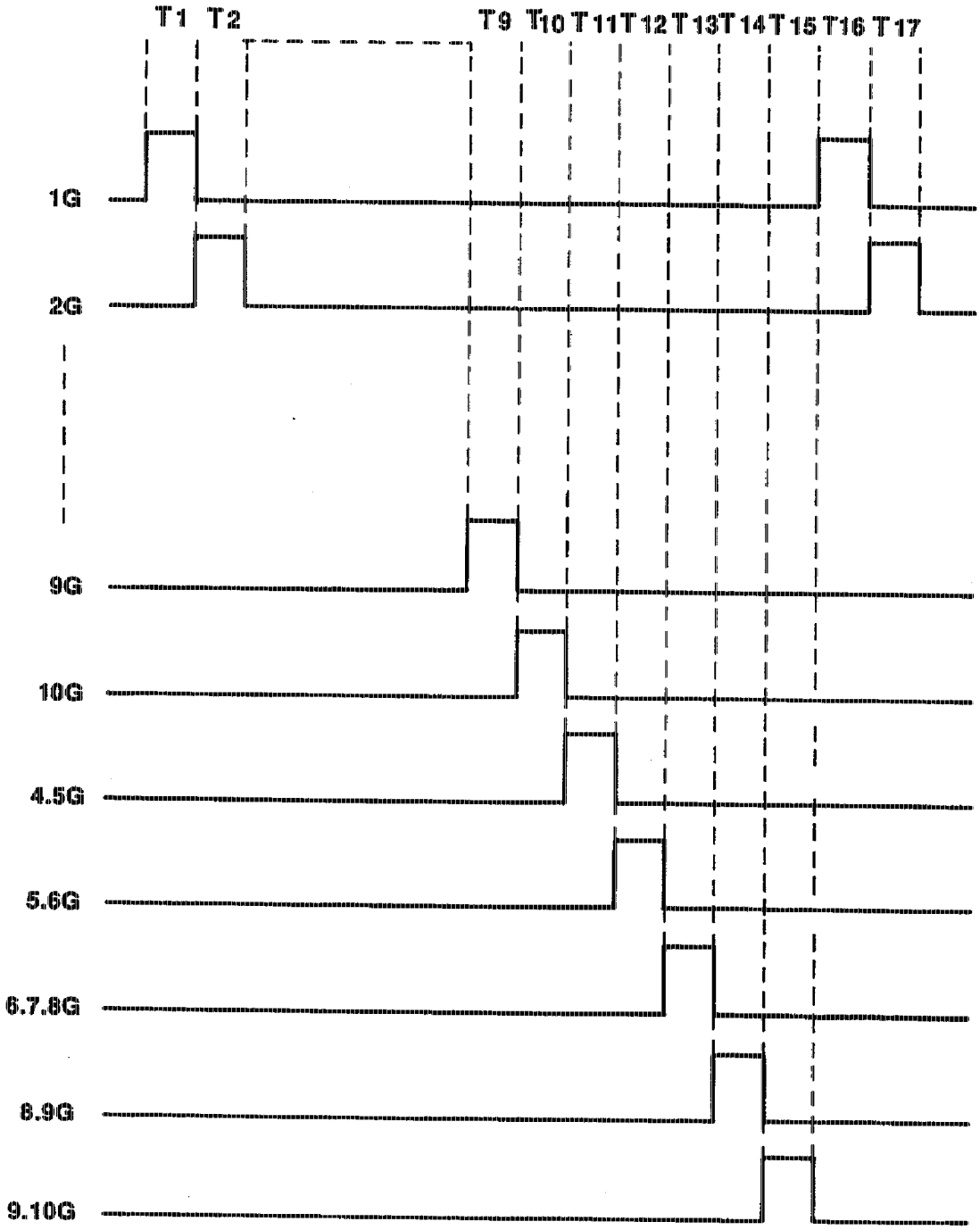
FIG. 8 is a timing chart showing a manner of driving of the fluorescent display device of FIG. 7.

The grids 1G to 10G, as shown in FIG. 4, are formed into a rectangular shape and arranged so as to be divided between the anode patterns for numerals of 1 to 20, between the anode patterns of the FIG. 8, and between the anode pattern for the numerals and that of the FIG. 8. In order to decrease the number of anode wirings, the grids are preferably arranged so as to be divided along the anode patterns of the FIG. 8.

In the illustrated embodiment, some of the anode patterns for function displaying are arranged so as to extend over two or more such grids. For example, the anode pattern "SHUFFLE REPEAT 1" is arranged so as to extend over three grids 6G to 8G.

The fluorescent display device of the illustrated embodiment also includes a plurality of anode wirings P1 to P22. FIG. 5 shows a manner of connection between the anode patterns and the anode wirings P1 to P22 in relation to the grids 1G to 10G. The anode patterns of the FIG. 8 each are divided into seven segments as shown in FIG. 4. In the anode patterns for numerals of 1 to 20 and the anode patterns of the FIG. 8, the segments of the anode patterns corresponding to the grids in odd numbers are connected to anode wirings common thereto and those corresponding to the grids in even numbers are connected to anode wirings common thereto.

Driving of the fluorescent display device of the illustrated embodiment constructed as described above is carried out at timings shown in FIG. 6. More particularly, the grids 1G to 10G are subsequently scanned while being shifted one by one in order so that any adjacent three grids of the grids 1G to 10G are constantly selected. In the illustrated embodiment, the maximum number of grids which are covered by one anode pattern or over which one anode pattern extends is set to be three, therefore, such scanning as described above eliminates a possibility that a shade or a dark portion occurs at a gap between the adjacent grids covered by the anode pattern.

The anode patterns are fed with a display signal in synchronism with the above-described scanning of the grids. When the maximum number of grids over which one anode pattern extends is indicated at n, the anode pattern which does not extend over two or more grids is fed with a display signal of a time period or length of 1/n based on a period of time for which each of the grids is scanned. In the illustrated embodiment, the maximum number of grids covered by one anode pattern is three, therefore, the anode pattern is fed with a display signal having a time length one third as long as the grid scanning time. The anode patterns which extend over two or more grids each are dividedly fed with a display signal having the same time length as the anode pattern which does not extend over a plurality of grids. This causes both anode patterns to have the same luminous time, resulting in exhibiting luminance of the same level.

For example, as shown in FIG. 6, segments a to g of the anode pattern which does not extend over two or more grids each are fed with a display signal having a time period one third as long as a time period of scanning of the grids 9G and 10G in synchronism with a timing of the scanning. When the anode pattern "MULTI" is driven simultaneous with the above-described feeding of a display signal, the anode wiring P16 is fed with a signal having a time length one half as long as the display signal fed to the segments a to g of the anode pattern two times while the grids 9G and 10G are being concurrently selected.

Referring now to FIG. 7, a further embodiment of a fluorescent display device according to the present invention is illustrated. In a fluorescent display device of the illustrated embodiment, grids 1G to 10G and anode patterns may be configured and arranged in substantially the same manner as the embodiment shown in FIG. 4. However, in the illustrated embodiment, as shown in FIG. 7, corresponding segments of anode patterns of the FIG. 8 in grids juxtaposed to each other are commonly connected, to decrease the number of anode wirings P1 to P14 as compared with that of the anode wirings P1 to P22 in the embodiment of FIG. 4.

In the illustrated embodiment, in order to permit anode patterns which do not extend over two or more grids to carry out displaying, as shown in FIG. 8, the grids 1G to 10G are successively scanned one by one and anode electrodes are fed with a display signal in synchronism with the scanning. Subsequently, in order to permit anode patterns which extend over a plurality of grids to carry out displaying, anode patterns corresponding to the grids 4G to 10G are scanned in order while shifting two or three anode patterns adjacent to each other in order. Simultaneously, anode electrode are fed with a display signal in synchronism with the scanning as in the above-described embodiment.

In the embodiment shown in FIG. 7, the anode patterns which are arranged so as to extend over two or more grids are commonly connected to anode wirings for every plural anode patterns, respectively. In one scanning cycle, all the grids are scanned one by one and subsequently the grids covered by the anode patterns are scanned two by two or three by three. Unfortunately, this fails to permit a duty ratio of the fluorescent display device to be increased. In view of the disadvantage, the illustrated embodiment may be so constructed that anode wirings for each of the anode patterns which extend over a plurality of grids are exclusively used for the anode pattern. Such construction permits the anode pattern extending two or more grids to be fed with a display signal when the grids are scanned one by one in order, resulting in increasing the duty ratio although the number of anode wirings is increased.

Figure 9:
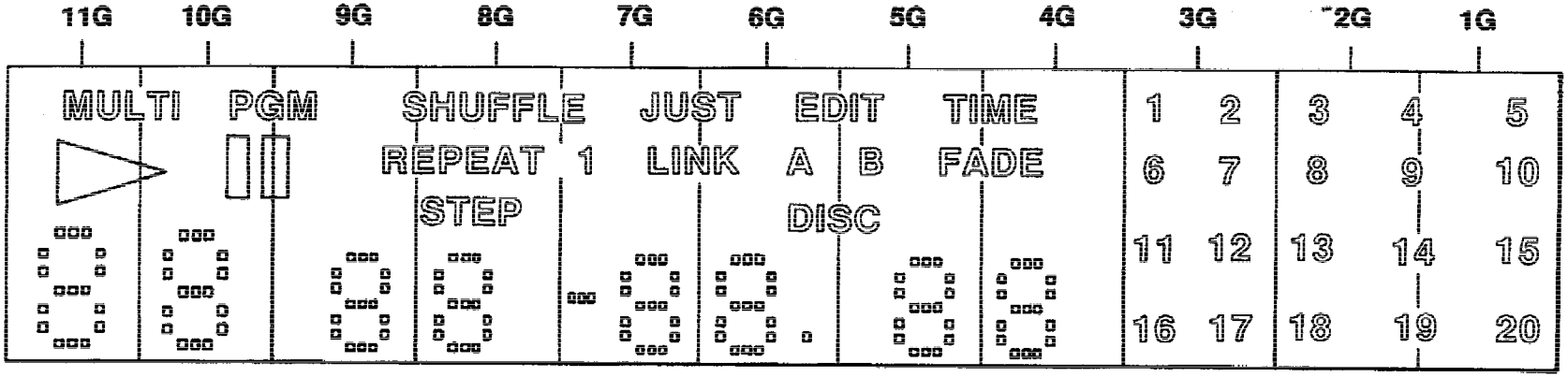
FIG. 9 is a schematic plan view showing still another embodiment of a fluorescent display device according to the present invention.

Referring now to FIG. 9, a configuration of anode patterns and mesh grids and arrangement thereof in still another embodiment of a fluorescent display device according to the present invention are illustrated. A fluorescent display device of the illustrated embodiment may be conveniently used as a display device for a CD player or a laser disc player. The fluorescent display device of the illustrated embodiment includes anode patterns for displaying numerals of 1 to 20, anode patterns of the FIG. 8 for displaying any desired numerals and the like, anode patterns for displaying a variety of functions, and the like. The anode patterns of the FIG. 8 each are divided into seven segments. Each of the anode patterns, as shown in FIG. 13, is connected to anode wirings P1 to P12, respectively.

Figure 10:
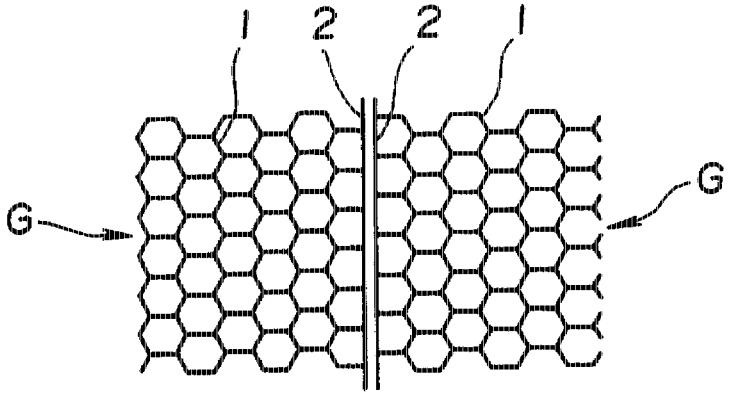
FIGS. 10 to 12 each are a fragmentary enlarged view showing mesh grids adjacent to each other in the fluorescent display device of FIG. 9.
Figure 11:
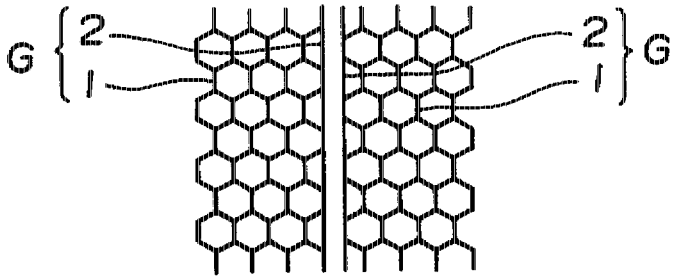
Figure 12:
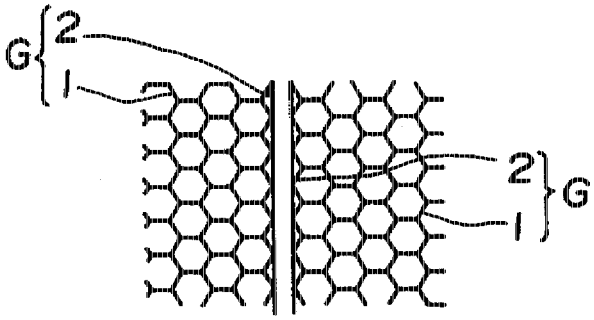

The fluorescent display device shown in FIG. 9 also includes a plurality of mesh grids G (1G to 11G) juxtaposed to each other so as to face the anode patterns and be spaced from the anode patterns at predetermined intervals. The mesh grids G are formed into the same rectangular shape and arranged so as to be spaced from each other at predetermined intervals. The mesh grids G, as shown in FIGS. 10 to 12, each include a mesh section 1 formed of a wire material into any suitable configuration such as a honeycomb-like shape, a rectangular shape or the like and a peripheral section 2 made of a wire material of the same diameter as the wire material for the mesh section 1 and formed into a linear shape. The mesh grid G may be formed by etching and the wire material of 15 to 30 μm in diameter may be used therefor. The mesh section 1 which is contiguous to the peripheral section 2 may be formed at an outer edge thereof into a shape shown in any one of FIGS. 10 to 12. A portion of the peripheral section 2 of the mesh grid which does not face the remaining mesh grids may be formed of a wire material of an increased diameter.

In the illustrated embodiment, a configuration of the mesh grid G is not set so as to be suitable for only a specific configuration of the anode patterns and specific arrangement thereof, resulting in some of the anode patterns facing a plurality of mesh grids adjacent thereto as shown in FIG. 9. As will be noted from FIGS. 9 and 13, for example, an anode pattern "MULTI" connected to the anode wiring P9 may be arranged so as to face the mesh grids 10G and 11G, whereas an anode pattern "SHUFFLE" connected thereto may be arranged so as to face the mesh grids 6G, 8G and 9G.

A mesh grid incorporated in the conventional fluorescent display device is so constructed that a peripheral section of the mesh grid surrounding a mesh section of the mesh grid is formed into a width larger than a diameter of a wire material for the mesh section. Such construction of the conventional fluorescent display device, when an anode pattern is arranged so as to face a plurality of mesh sections, causes a part of the anode pattern to be hidden or covered by the peripheral section of the mesh grid, to thereby be put out of sight. Thus, in the conventional fluorescent display device, it is required to determine a configuration of the mesh grids in conformity to a configuration of the anode patterns for every fluorescent display device. On the contrary, in the illustrated embodiment, the mesh grid G is so constructed that the peripheral section 2 is formed of a wire material having a decreased diameter similar to that of a wire material for the mesh section 1. Thus, the illustrated embodiment effectively prevents a part of the anode pattern from being covered by the peripheral section 2 of the mesh grid even when the anode pattern is arranged so as to face a plurality of mesh grids. Therefore, the illustrated embodiment prevents the mesh grids from putting a luminous display of the anode patterns out of sight, so that the mesh grids may be commonly used for any fluorescent display device irrespective of a configuration of the anode patterns and a pattern of arrangement thereof.

Also, when a plurality of mesh grids divided are arranged, the illustrated embodiment may be constructed in such a manner that at least a part of the peripheral section of the mesh grid is removed to cause the mesh sections to be juxtaposed to each other at predetermined intervals. However, when the mesh section is formed into a honeycomb-like shape, it is impossible to form an outer periphery of the mesh section into a linear shape. This fails to keep a distance between the mesh sections adjacent to each other constant, resulting in the distance being varied. Thus, when the mesh grids are arranged in such a manner that a minimum distance between the mesh grids is set on the basis of an outwardly projecting portion of the honeycomb-like configuration, a distance between the mesh grids at a position other than a position of the minimum distance is excessively increased. Nevertheless, in the illustrated embodiment, the peripheral section 2 of the mesh grid G is formed of a wire material of the same diameter as that for the mesh section 1 into a straight or linear shape, so that a distance between the mesh grids adjacent to each other may be kept substantially constant without any significant variation. For example, the distance or interval between the mesh grids may be set to be as small as about 0.1 to 0.2 mm.

Figure 14:
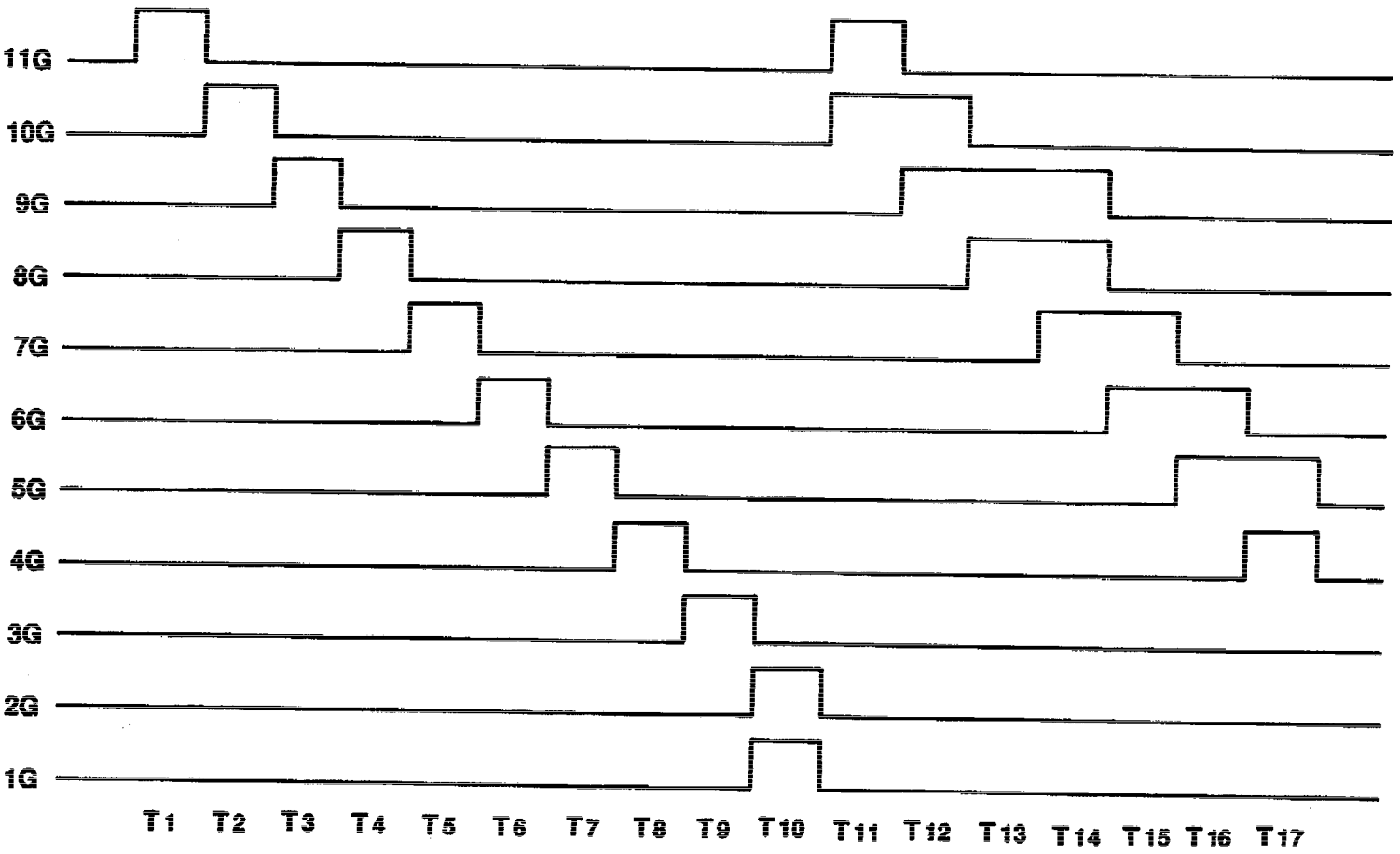
FIG. 14 is a timing chart showing an example of a manner of driving of the fluorescent display device of FIG. 9.

Now, an example of driving of the fluorescent display device of the illustrated embodiment constructed as described above will be described hereinafter with reference to FIG. 14. First, the mesh grids 11G to 1G are scanned one by one in order at timings T1 to T10 in a first half of one cycle of grid scanning. In this instance, the mesh grids 1G and 2G are concurrently scanned at the timing T10. Then, at timings T11 to T17 in the latter half, the mesh grids are scanned so that a plurality of mesh grids facing the common anode pattern may be concurrently selected. Also, the anode wirings P1 to P12 are fed with a display signal in synchronism with the above-described scanning of the mesh grids. This permits electrons to impinge on a portion of the anode patterns positioned at each of gaps defined between the mesh grids adjacent to each other as well, resulting in the portion likewise emitting light without forming a dark region.

Figure 15:
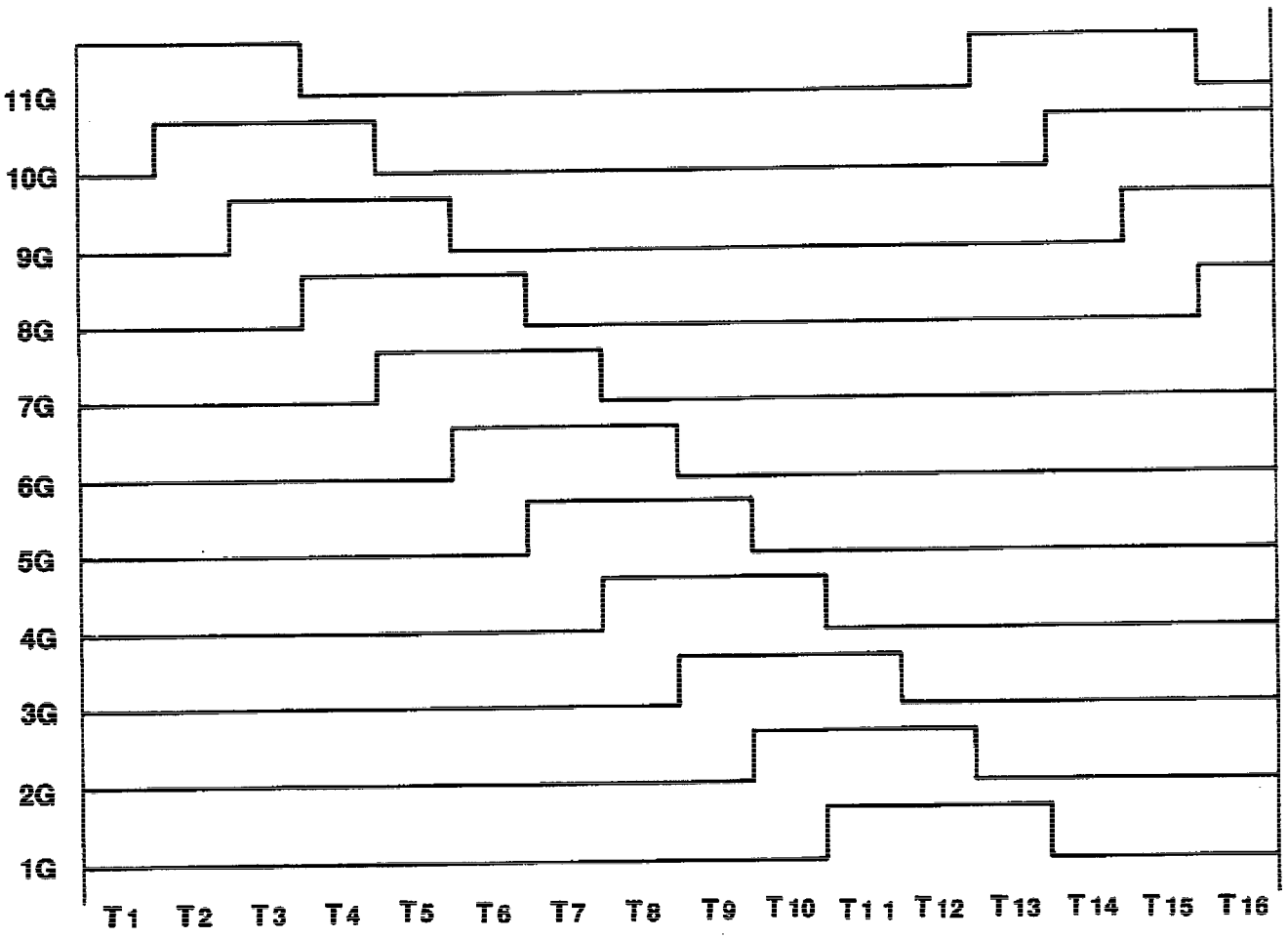
FIG. 15 is a timing chart showing another example of a manner of driving of the fluorescent display device of FIG. 9.

FIG. 15 shows another example of driving of the fluorescent display device of the illustrated embodiment. In the example of FIG. 15, a maximum number of mesh grids adjacent to each other over which the single anode pattern extends are fed with a display signal and scanned while being shifted one by one in order. More particularly, in the illustrated embodiment, the mesh grids are scanned while being shifted one by one in a predetermined direction so that three mesh grids adjacent to each other may be turned on. Then, the anode wirings P1 to P12 are fed with a display signal in synchronism with the scanning. This permits electrons to impinge on a portion of the anode patterns positioned at each of gaps defined between the mesh grids adjacent to each other as well, resulting in the portion likewise emitting light without forming a dark region.

The fluorescent display device of the embodiment shown in FIG. 9 is adapted to be applied to a display device for a CD player. However, the fluorescent display device of the present invention can be directed to a variety of applications without being limited to such a specific application such as a CD player and permits the anode patterns to be further complicated depending on the application without changing a configuration of the grids.

Figure 16:
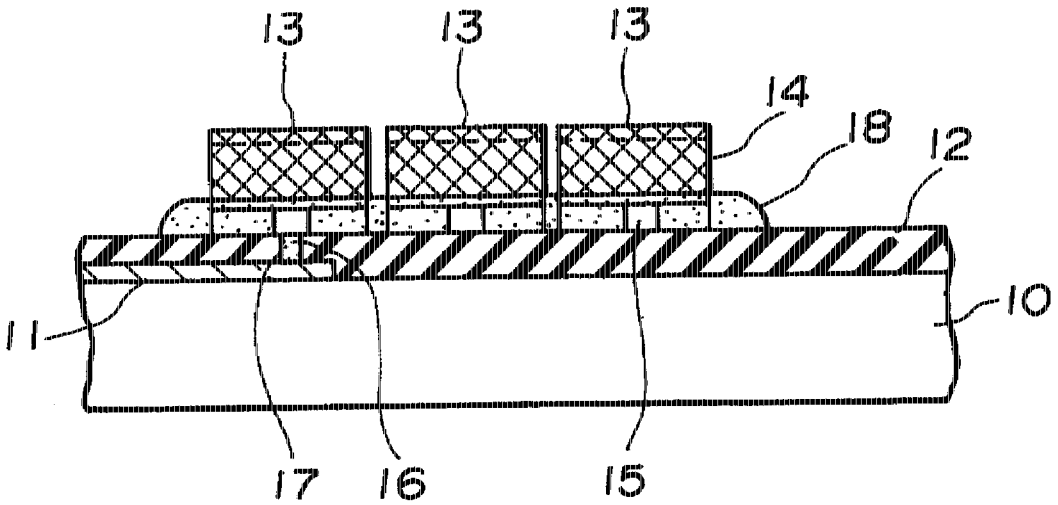
FIG. 16 is a fragmentary vertical sectional view showing an example of connection between grids in a still further embodiment of a fluorescent display device according to the present invention.

Referring now to FIG. 16, yet another embodiment of a fluorescent display device according to the present invention is illustrated. A fluorescent display device of the illustrated embodiment is constructed in such a manner that a plurality of grids which function as common parts so as to be accommodated to any anode pattern are juxtaposed to each other. Also, the fluorescent display device is constructed so as to reduce grid terminals led out of the fluorescent display device as far as possible.

The fluorescent display device of the illustrated embodiment includes a substrate 10 which constitutes a part of an envelope for the fluorescent display device. The substrate 10 is provided thereon with wiring conductors 11 made of a thin Al film or the like. The wiring conductors 11 are covered with an insulating layer 12, on which a plurality of grids 13 are juxtaposed to each other.

The grids 13 comprise rectangular meshes formed by photo-etching or the like and arranged so as to be spaced from each other at micro intervals. Supposing that the grids are formed into a width of, for example, about 2 to 5 mm, intervals or distances between the grids 13 may be as small as 0.1 to 0.5 mm. The interval exceeding about 0.5 mm causes the amount of electrons impinging on a portion of the anode pattern positioned at each of gaps defined between the grids to be reduced. Light emitted from the portion of the anode pattern is directly observed because it does not pass through the grid; so that the portion of the anode pattern is darkened as compared with a portion of the anode pattern positioned below the grid, leading to deterioration in display quality.

The grids 13 each are formed on each of both ends thereof with a rising portion 14, which is then provided with a fixing tab 15. The insulating layer 12 is formed at a predetermined portion thereof with a through-hole 16, so that the tab 15 of the grid 13 and the wiring conductor are connected to each other through a conductive adhesive material 17 filled in the through-hole 16. The grid 13 thus connected to the wiring conductor 11 and two grids 13 adjacent thereto are connected to each other on the insulating layer 12 by means of a conductive adhesive material 18. This results in the three grids 13 arranged so as to be independent from each other being electrically connected as desired depending on each of single anode patterns (not shown) in the fluorescent display device, to thereby permit the number of external terminals for grids 13 to be reduced as compared with the number of grids 13.

Figure 17:
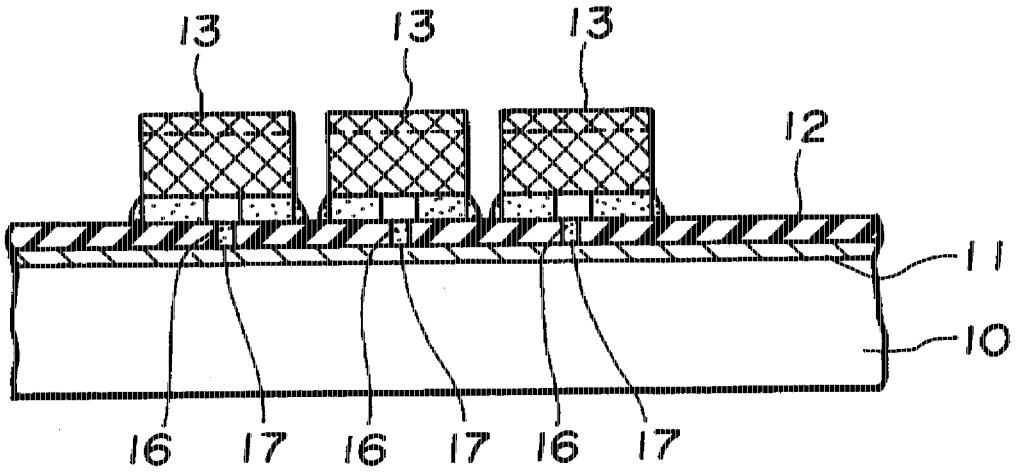
FIG. 17 is a fragmentary vertical sectional view showing another example of connection between grids in the fluorescent display device shown in FIG. 16.
Figure 18:
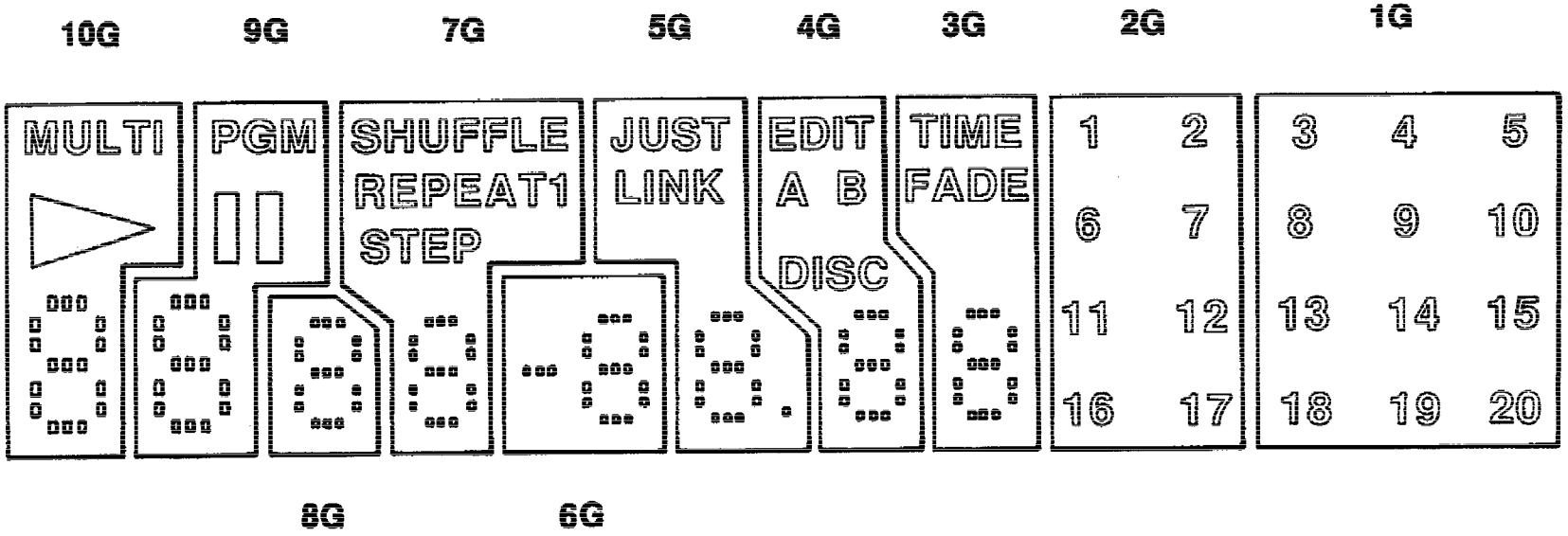
FIG. 18 is a schematic plan view showing a configuration of grids and anode patterns and arrangement thereof in a conventional fluorescent display device.

FIG. 17 shows a modification of the embodiment described above with reference to FIG. 16. A fluorescent display device of the modification is so constructed that three grids adjacent to each other are connected to a common wiring conductor 11 via a through-hole formed at an insulating layer 12 and a conductive adhesive material 17 filled in the through-hole 12. Such construction of the modification likewise permits a plurality of grids 13 to form a grid region depending on an anode pattern and the number of external terminals for the grids 13 to be reduced as compared with the number of grids.

As can he seen from the foregoing, the fluorescent display device of the present invention permits the grids to be used as common parts and the anode patterns to be freely set as desired without being restricted by a configuration of the grids.

Also, in method of the present invention, the anode pattern is arranged so as to extend over a plurality of grids juxtaposed to each other, resulting in including a portion positioned at each of gaps defined between the grids. Electrons likewise impinge on the portion of the anode pattern, so that the portion may be prevented from being darkened as compared with the remaining portion of the anode pattern. This permits the grids to be previously prepared irrespective of the anode pattern and be commonly used for every envelope of the same dimensions. Also, this permits the grids to be unified into a simplified configuration, resulting in support members for fixedly mounting the grids in the envelope being simplified in structure. Further, in the fluorescent display device of present invention, it is not required to conform the grids to the anode pattern, so that the grids may be formed into substantially the same area. Therefore, the present invention eliminates a necessity of setting a driver, a power supply and the like on the basis of a grid of an increased area through which a large grid current flows, leading to unification of the parts.

In addition, the fluorescent display device of the present invention permits the mesh grids to be formed into the same configuration, so that the grids may be used as common parts. Also, the mesh grids may be formed into the same area, therefore, a driver IC for driving the mesh grids may be limited to only one kind, leading to a decrease in manufacturing cost of the fluorescent display device. Further, the opposite peripheral sections of the mesh grids adjacent to each other are formed of a wire material having the same diameter as that for the mesh section, so that light emitted from the anode pattern is prevented from being interrupted, resulting in a luminous display of the anode patterns being uniform. Moreover, the mesh grids which are arranged adjacent to each other may be uniformly spaced from each other at micro intervals, to thereby substantially prevent short-circuiting therebetween.

Furthermore, the fluorescent display device of the present invention permits the number of external terminals for the grids to be reduced as compared with the number of grids even when the grids are formed into common parts so as to be accommodated to any anode pattern and juxtaposed to each other.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

a plurality of grids juxtaposed to each other;

a plurality of anode wirings; and a plurality of first anode patterns connected to said plurality of anode wirings and disposed under said plurality of grids;

wherein first ones of said plurality of first anode patterns disposed under odd ones of said plurality of grids are commonly connected to a first one of said plurality of anode wirings, and second ones of said plurality of first anode patterns disposed under even ones of said plurality of grids are commonly connected to a second separate one of said plurality of anode wirings.

2. A fluorescent display device as recited in claim 1, further comprising:

a plurality of second anode patterns connected to said plurality of anode wirings and disposed under said plurality of grids, wherein at least one of said plurality of second anode patterns extends over at least two adjacent ones of said plurality of grids and is connected to a third separate one of said plurality of anode wirings.

3. A fluorescent display device as recited in claim 1, comprising:

said plurality of first anode patterns each extending over only one of said plurality of grids.

4. A fluorescent display device comprising:

a plurality of anode patterns disposed on a surface of an anode substrate;

a plurality of grids correspondingly disposed to said plurality of anode patterns a predetermined distance away from said plurality of anode patterns, a predetermined number of said plurality of grids being conductively connected together;

an electrode connected to said predetermined number of said plurality of grids:

an insulative material disposed on said substrate having a through-hole; and a conductive material disposed on said insulative material over said through-hole;

said predetermined number of said plurality of grids being disposed upon said conductive material and said electrode being connected to said conductive material through said through-hole.

5. A fluorescent display device comprising:

a plurality of anode patterns disposed on a surface of an anode substrate:

a plurality of grids correspondingly disposed to said plurality of anode patterns a predetermined distance away from said plurality of anode patterns, a predetermined number of said plurality of grids being conductively connected together:

an electrode connected to said predetermined number of said plurality of grids:

an insulative material disposed on said substrate; and a plurality of conductive portions insulated from each other on said insulative material, one of said plurality of grids being disposed on each of said plurality of conductive portions; and a plurality of through-holes provided in said insulative material correspondingly disposed for said plurality of conductive portions;

said electrode being connected to a predetermined number of said plurality of conductive portions through corresponding ones of said plurality of through-holes.

* * * * *